US010124944B2

(12) United States Patent
Smalley

(10) Patent No.: US 10,124,944 B2
(45) Date of Patent: Nov. 13, 2018

(54) CARTON WITH OPENING FEATURE

(71) Applicant: Graphic Packaging International, Inc., Atlanta, GA (US)

(72) Inventor: Brian Smalley, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 10 days.

(21) Appl. No.: 15/156,692

(22) Filed: May 17, 2016

(65) Prior Publication Data

US 2016/0340096 A1 Nov. 24, 2016

Related U.S. Application Data

(60) Provisional application No. 62/179,784, filed on May 18, 2015.

(51) Int. Cl.

| | |
|---|---|
| ***B65D 71/36*** | (2006.01) |
| ***B65D 5/54*** | (2006.01) |
| ***B65D 5/02*** | (2006.01) |

(52) U.S. Cl.

CPC ..... *B65D 71/36* (2013.01); *B65D 2571/0058* (2013.01); *B65D 2571/0066* (2013.01);
(Continued)

(58) Field of Classification Search

CPC ..... B65D 71/36; B65D 5/248; B65D 5/22; B65D 5/241; B65D 5/30; B65D 5/62;
(Continued)

(56) References Cited

U.S. PATENT DOCUMENTS 2,586,301 A * 2/1952 Castle ..... B65D 5/18 206/193
3,912,156 A 10/1975 May
(Continued)

FOREIGN PATENT DOCUMENTS

EP 0 950 617 A2 10/1999
EP 1613537 B1 11/2009
(Continued)

OTHER PUBLICATIONS

International Search Report and Written Opinion for PCT/US2016/032849 dated Aug. 16, 2016.

*Primary Examiner* — Christopher Demeree
(74) *Attorney, Agent, or Firm* — Womble Bond Dickinson (US) LLP

(57) ABSTRACT

Cartons for holding a plurality of containers are disclosed herein. The cartons comprise a plurality of panels that extends at least partially around an interior of the carton. The plurality of panels comprises a top panel or panels, a bottom panel, a first side panel, and a second side panel. At least two end flaps are respectively foldably attached to respective panels of the plurality of panels. The end flaps are overlapped with respect to one another and thereby at least partially form a closed end of the carton. The cartons comprise at least one curved corner and at least one dispenser for allowing removal of at least one article from the carton. The at least one dispenser comprises a dispenser panel, and the dispenser panel comprises at least a portion of the at least one curved corner. The cartons may comprise a handle in the top panel or panels.

42 Claims, 12 Drawing Sheets

(52) U.S. Cl.
CPC ..... *B65D 2571/00141* (2013.01); *B65D 2571/00444* (2013.01); *B65D 2571/00456* (2013.01); *B65D 2571/00462* (2013.01); *B65D 2571/00524* (2013.01); *B65D 2571/00543* (2013.01); *B65D 2571/00561* (2013.01); *B65D 2571/00574* (2013.01); *B65D 2571/00728* (2013.01)

(58) Field of Classification Search
CPC ..... B65D 5/68; B65D 65/403; B31B 3/26; B31B 3/60
USPC ..... 229/182.1, 164.1
See application file for complete search history.

(56) References Cited

U.S. PATENT DOCUMENTS

| | | | | |
|---|---|---|---|---|
| 4,063,679 | A | 12/1977 | Henry | |
| D250,748 | S | 1/1979 | Leger | |
| 5,350,110 | A | 9/1994 | Will | |
| 5,848,749 | A | 12/1998 | Ljungstrom | |
| 5,944,253 | A * | 8/1999 | Miller | B65D 71/36 206/145 |
| D425,436 | S | 5/2000 | Wei | |
| D426,154 | S | 6/2000 | de Baschmakoff | |
| 6,155,480 | A | 12/2000 | Botsford | |
| D436,859 | S | 1/2001 | Botsford | |
| 6,364,199 | B1 | 4/2002 | Rose | |
| D470,769 | S | 2/2003 | Holthaus | |
| D489,609 | S | 5/2004 | Holthaus | |
| D502,097 | S | 2/2005 | Holthaus | |
| D511,248 | S | 11/2005 | Premper | |
| 7,331,509 | B2 | 2/2008 | Bates et al. | |
| 7,357,254 | B2 | 4/2008 | Auclair et al. | |
| 7,374,043 | B2 | 5/2008 | Holley, Jr. et al. | |
| 7,621,438 | B2 | 11/2009 | Spivey, Sr. | |
| 7,665,653 | B2 | 2/2010 | Fitzwater | |
| 7,762,397 | B2 | 7/2010 | Coltri-Johnson | |
| 7,874,477 | B2 | 1/2011 | Sutherland et al. | |
| 7,992,765 | B2 | 8/2011 | Brand | |
| 8,061,587 | B2 | 11/2011 | Blin | |
| D660,143 | S | 5/2012 | Stowe | |
| 8,220,701 | B2 | 7/2012 | Fontaine et al. | |
| D684,042 | S | 6/2013 | Betzig | |
| 8,550,332 | B2 | 10/2013 | DeBusk | |
| D737,137 | S | 8/2015 | Exner | |
| 9,096,344 | B1 | 8/2015 | Block | |
| 9,132,936 | B2 | 9/2015 | Kohler | |
| 9,392,888 | B2 | 7/2016 | Spivey, Sr. | |
| 2003/0116612 | A1 | 6/2003 | Polloni et al. | |
| 2005/0199692 | A1* | 9/2005 | Nelson | B65D 5/029 229/182.1 |
| 2007/0090175 | A1 | 4/2007 | Schemmel | |
| 2011/0095075 | A1 | 4/2011 | Pinkstone | |
| 2011/0147444 | A1 | 6/2011 | Fitzwater | |
| 2016/0244231 | A1 | 8/2016 | Alexander et al. | |

FOREIGN PATENT DOCUMENTS

| | | |
|---|---|---|
| EP | 2271558 B1 | 1/2015 |
| FR | 2163317 | 7/1973 |
| GB | 1 317 667 | 5/1973 |
| WO | WO 01/44077 A1 | 6/2001 |
| WO | WO 2012/009502 A2 | 1/2012 |
| WO | WO 2014/161684 A1 | 10/2014 |

* cited by examiner

CARTON WITH OPENING FEATURE

CROSS-REFERENCE TO RELATED APPLICATIONS

This application claims the benefit of U.S. Provisional Patent Application No. 62/179,784 filed on May 18, 2015.

INCORPORATION BY REFERENCE

The disclosure of U.S. Provisional Patent Application No. 62/179,784, which was filed on May 18, 2015, is hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having at least one dispensing feature.

SUMMARY OF THE DISCLOSURE

In general, one aspect of the disclosure is directed to a carton for holding a plurality of containers. The carton comprises a plurality of panels that extends at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another and thereby at least partially form a closed end of the carton. The carton further comprises a curved corner and a dispenser for allowing removal of at least one article from the carton. The curved corner extends from at least one panel of the plurality of panels to the at least partially closed end of the carton. The dispenser comprises a dispenser panel that is at least partially defined by a tear line in the carton, and the dispenser panel comprises at least a portion of the curved corner.

In another aspect, the disclosure is generally directed to a blank for forming a carton for holding a plurality of containers. The blank comprises a plurality of panels for being positioned to extend at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another and thereby may be positioned to at least partially form a closed end of the carton. The carton formed from the blank further comprises a curved corner and a dispenser for removing at least one article from the carton formed from the blank. The curved corner extends from at least one panel of the plurality of panels to the at least partially closed end of the carton formed from the blank. The dispenser comprises a dispenser panel that is at least partially defined by a tear line in the carton, and the dispenser panel comprises at least a portion of the curved corner.

In another aspect the disclosure is generally directed to a method of forming a carton comprising obtaining a carton blank comprising: a plurality of panels for being positioned to extend at least partially around an interior of the carton. The plurality of panels comprises a top panel, a bottom panel, a first side panel, and a second side panel. At least two end flaps are respectively foldably attached to respective panels of the plurality of panels. The end flaps are overlapped with respect to one another and thereby may be positioned to at least partially form a closed end of the carton. The carton formed from the blank further comprises a curved corner and a dispenser for removing at least one article from the carton formed from the blank. The curved corner extends from at least one panel of the plurality of panels to the at least partially closed end of the carton formed from the blank. The dispenser comprises a dispenser panel that is at least partially defined by a tear line in the carton, and the dispenser panel comprises at least a portion of the curved corner. The method further comprises forming an interior of the carton at least partially defined by the plurality of panels and at least partially closing an end of the carton by at least partially overlapping the at least two end flaps; and forming a curved corner extending from the at least one panel of the plurality of panels to the at least partially closed end by folding the corner portion to form the curved corner.

Those skilled in the art will appreciate the above stated advantages and other advantages and benefits of various additional embodiments from reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles or aluminum cans) as disposed within the carton embodiments. In this specification, the terms "lower," "bottom," "upper" and "top" indicate orientations determined in relation to fully erected and upright cartons.

Figure 1:
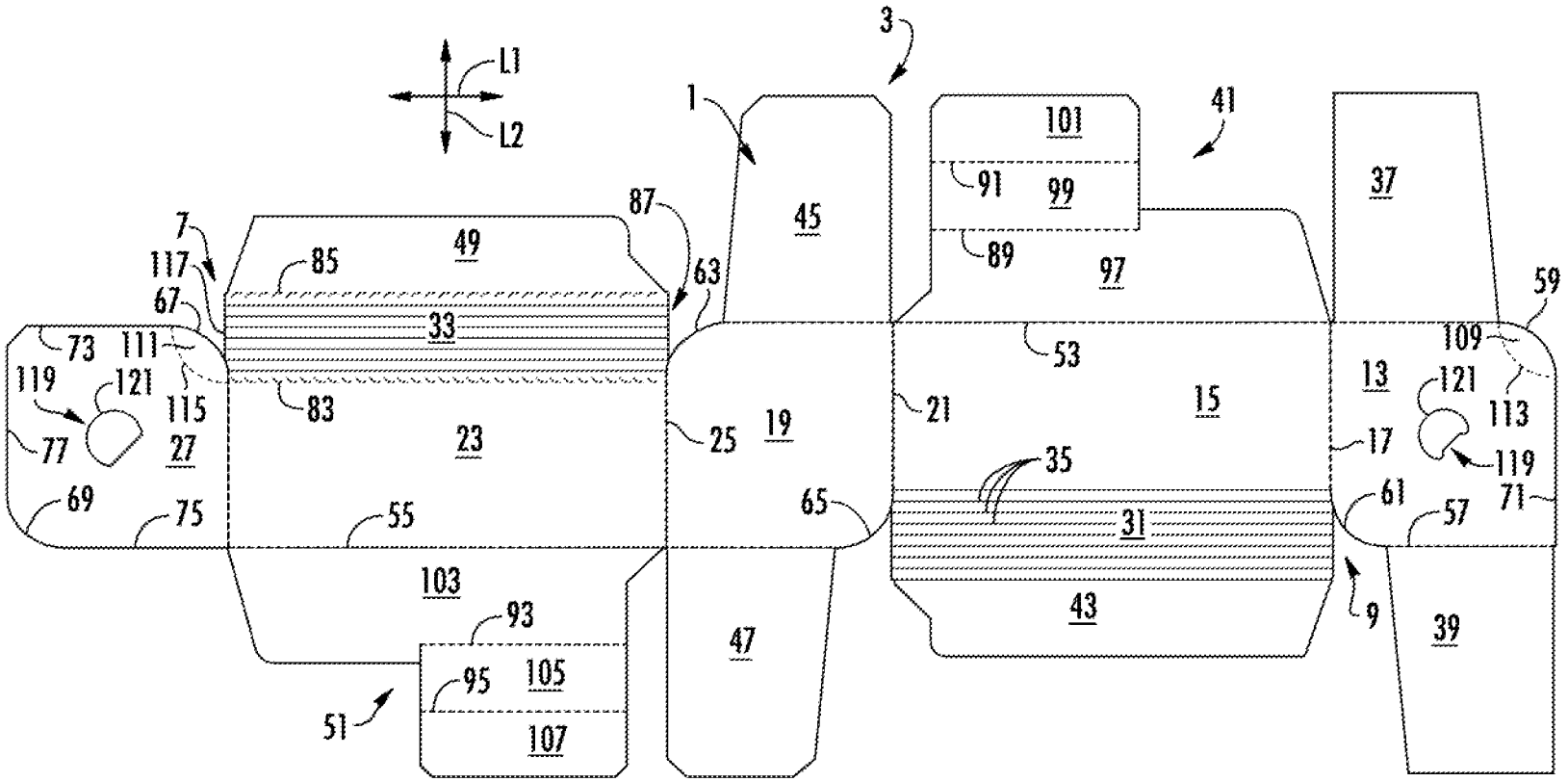
FIG. 1 is a plan view of an exterior surface of a blank for forming a carton according to a first embodiment of this disclosure.
Figure 2:
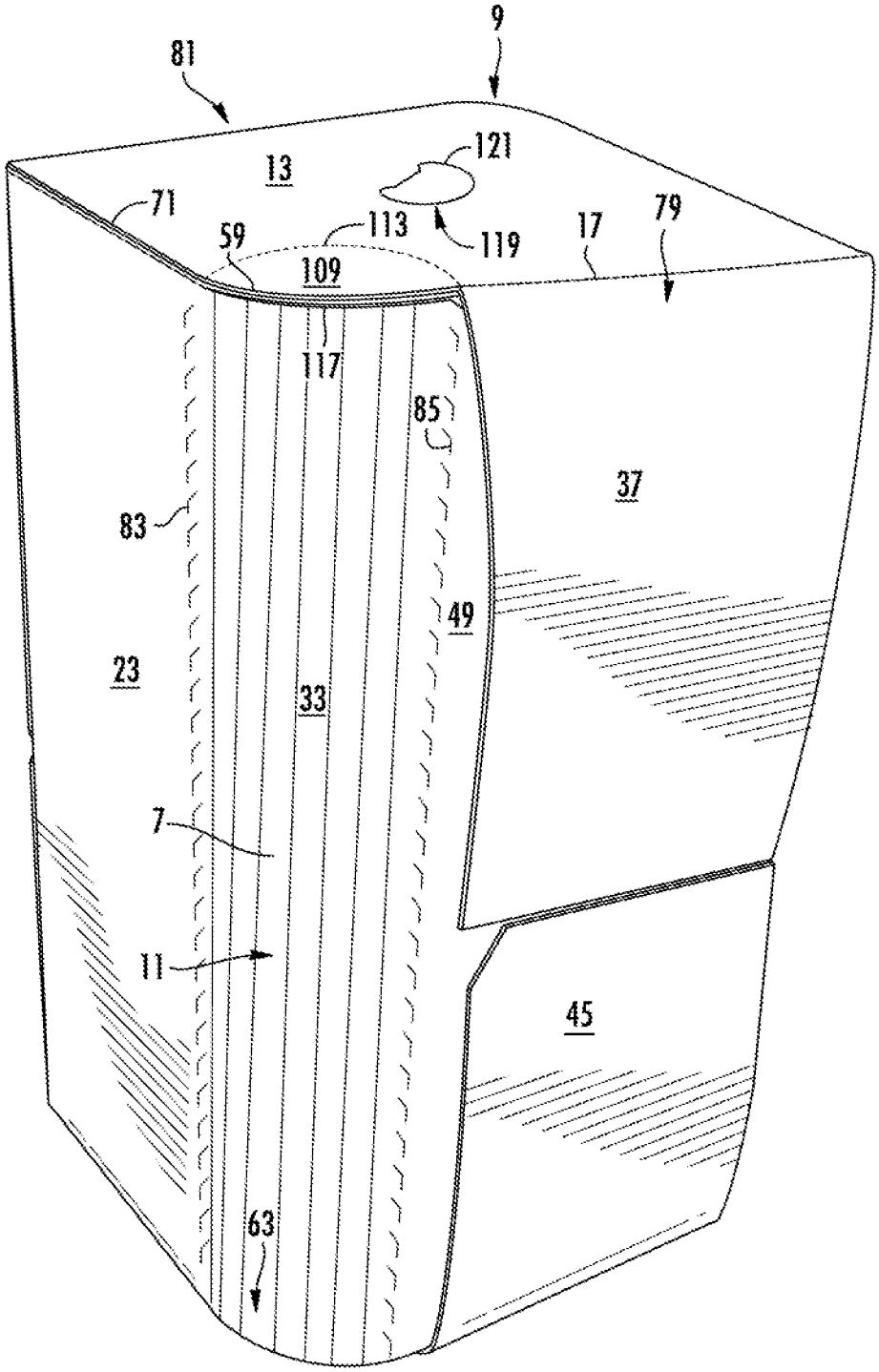
FIG. 2 is a perspective view of a fully formed carton according to a first embodiment of this disclosure.
Figure 3:
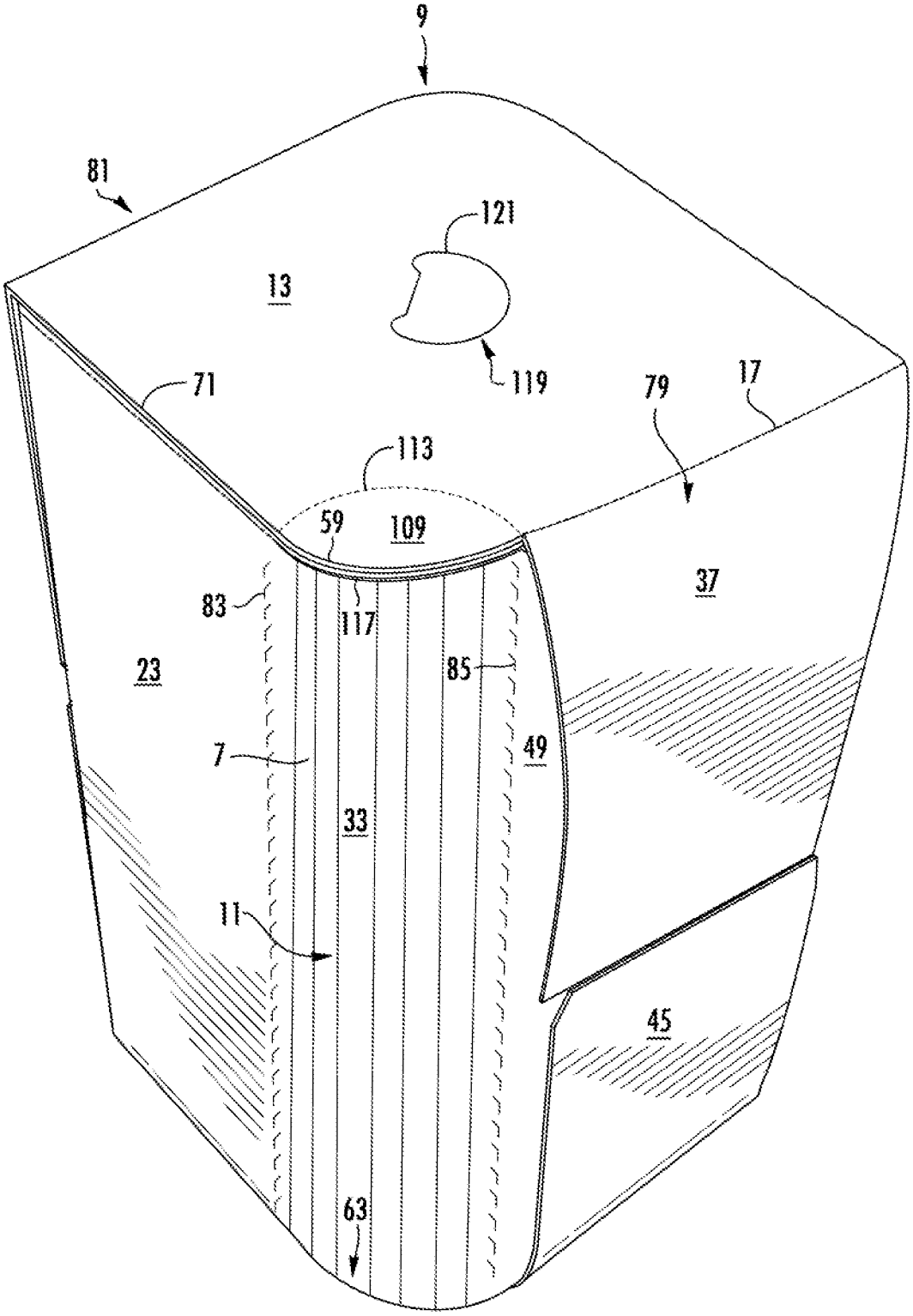
FIG. 3 is a perspective view of a fully formed carton according to a first embodiment of this disclosure.
Figure 5:
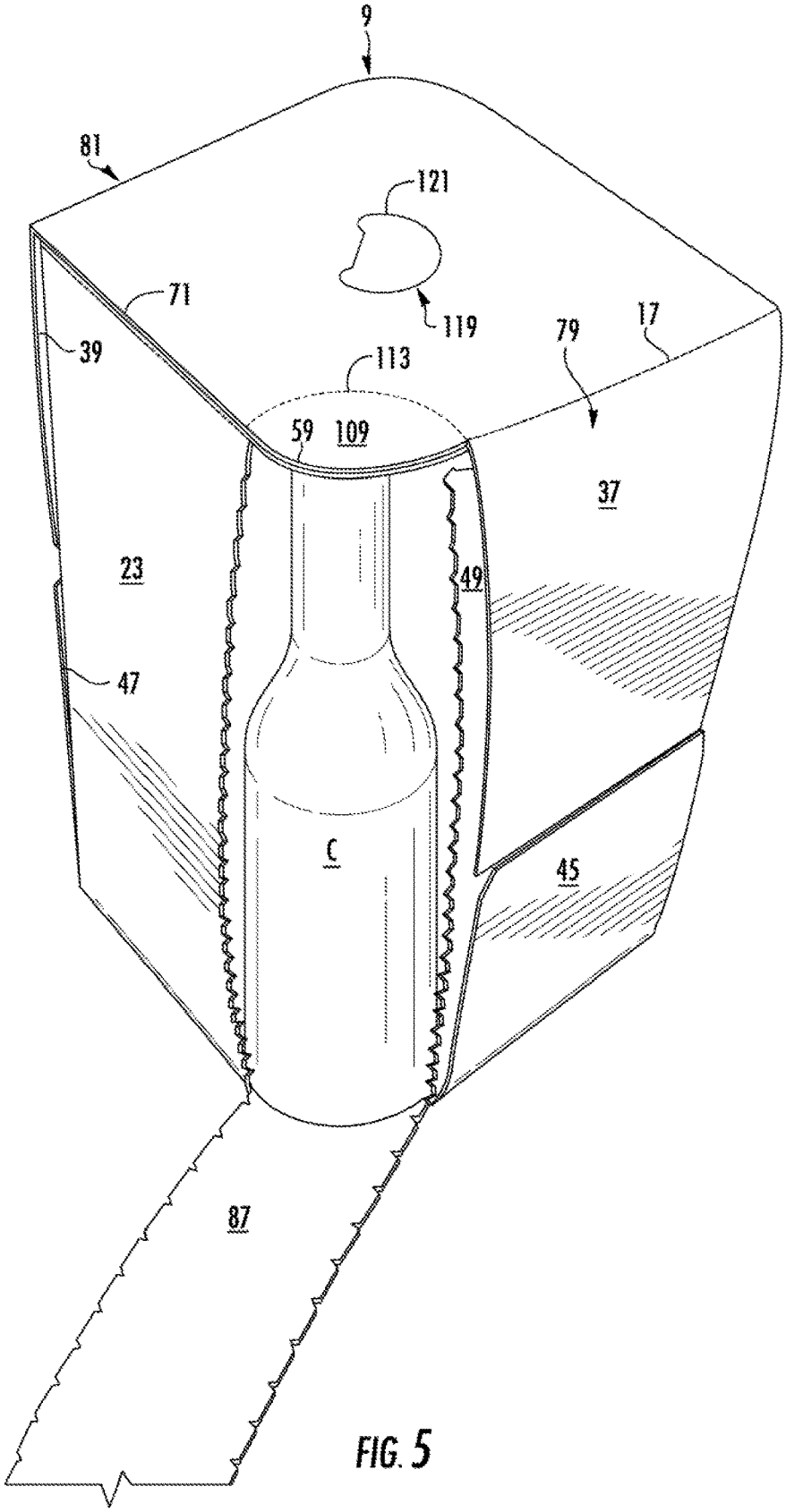
FIG. 5 is a perspective view of a carton with a partially separated opening feature according to a first embodiment of this disclosure.
Figure 6:
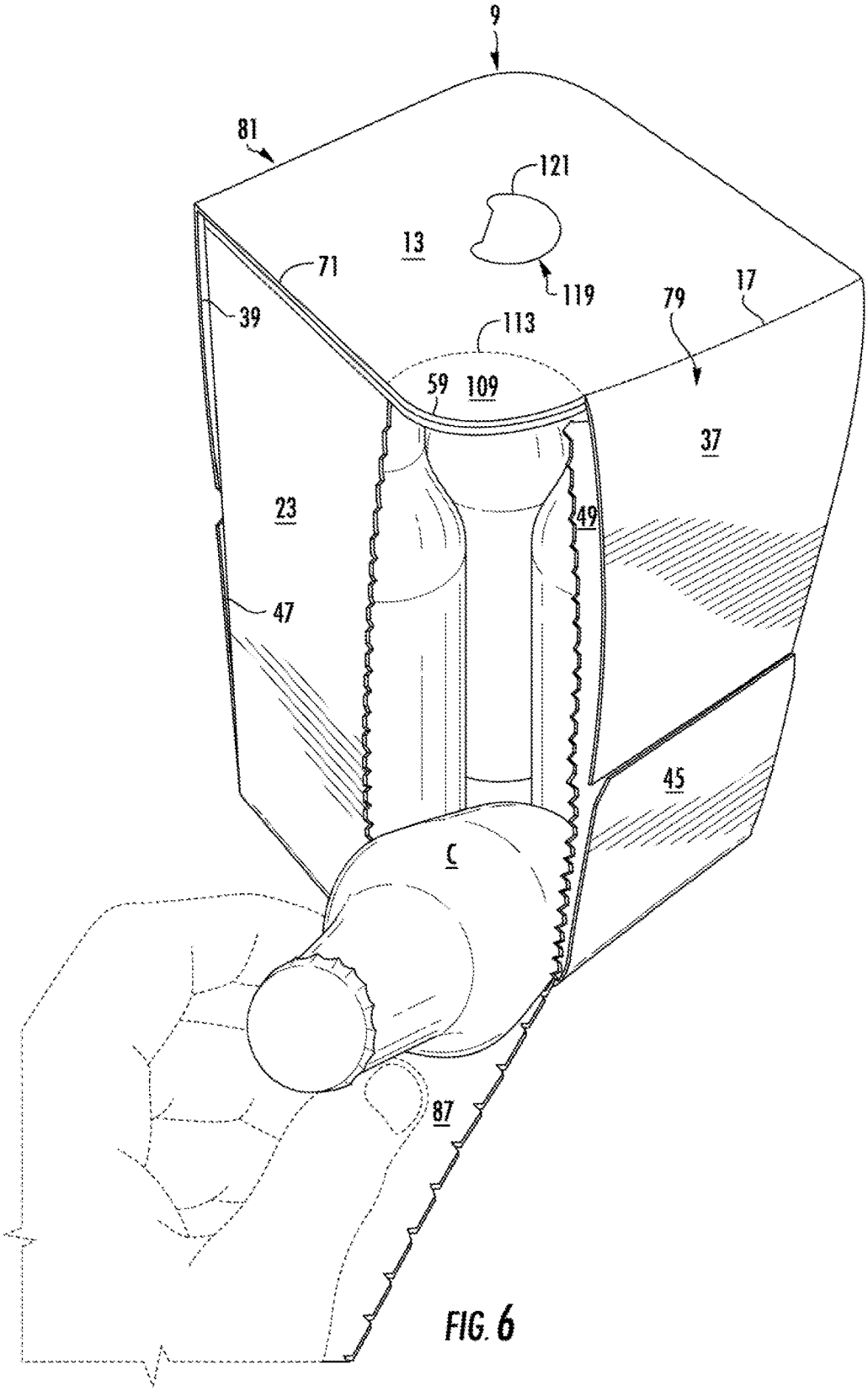
FIG. 6 is a perspective view of a fully formed carton with a partially separated opening feature and a container being removed according to a first embodiment of this disclosure.
Figure 7:
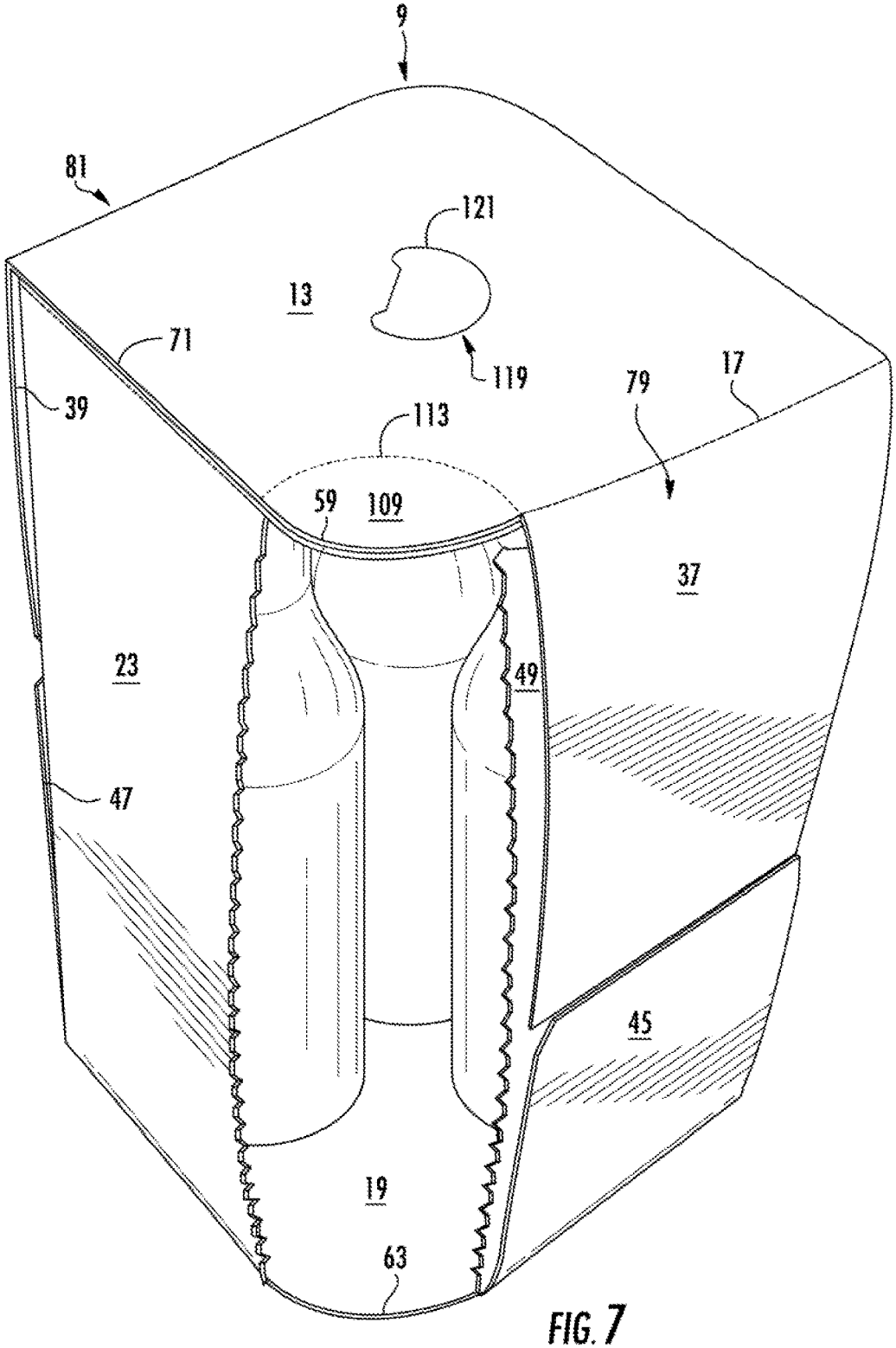
FIG. 7 is a perspective view of a fully formed carton with a separated opening feature and a removed container according to a first embodiment of this disclosure.

FIG. 1 is a plan view of the exterior side 1 of a blank, generally indicated at 3, used to form a carton 5 (FIG. 2), according to one exemplary embodiment of the disclosure. The carton 5 can be used to house a plurality of articles such as containers C (FIG. 5). As shown in FIG. 1, the carton 5 according to one embodiment is sized to house four containers C in a single layer in a 2×2 arrangement, but it is understood that the carton 5 may be sized and shaped to hold containers of a different or same quantity in more than one layer and/or in different row/column arrangements (e.g., 1×4, 1×6, 2×3, 3×6, 2×6×2, 3×3×2, 4×5, 3×5, 2×9, 2×6, 3×4, etc.). The carton 5 has a dispenser 7 for accessing the containers C in the carton 5.

According to some embodiments, the carton 5 has two curved corners 9, 11. As will be discussed in further detail below, the dispenser 7 is located at one or more of the curved corners 9, 11 of the carton. The carton 5 can be closed (FIG. 2) for containing containers C and opened (FIG. 5) to allow easy access to the containers C in the carton 5.

In the embodiment of FIG. 1, the carton blank 3 has a longitudinal axis L1 and a lateral axis L2. The blank 3 comprises a first top panel 13 foldably connected to a first side panel 15 at a first lateral fold line 17. A bottom panel 19 is foldably connected to the first side panel 15 at a second lateral fold line 21. A second side panel 23 is foldably connected to the bottom panel 19 at a third lateral fold line 25. A second top panel 27 is foldably connected to the second side panel 23 at a fourth lateral fold line 29. The first and second side panels 15, 23 each include a respective corner portion 31, 33 having a plurality of longitudinal fold lines 35. In alternative embodiments, the blank 3 can have alternative panel arrangements.

The first top panel 13 is foldably connected to a first top end flap 37 and a second top end flap 39. The first side panel 15 is foldably connected to a first side end flap 41 and a second side end flap 43. The bottom panel 19 is foldably connected to a first bottom end flap 45 and a second bottom end flap 47. The second side panel 23 is foldably connected to a first side end flap 49 and a second side end flap 51.

The first top end flap 13, first side end flaps 41, 49, and first bottom end flap 45 extend along a first marginal area of the blank 3, and the top end flap 13, bottom end flap 45, and side end flap 41 are foldably connected at a first longitudinal fold line 53 that extends along a length of the blank from the first top panel 13 to the bottom panel 19. The second top end flap 39, second side end flaps 43, 51, and second bottom end flap 47 extend along a second marginal area of the blank 3, and the bottom end flap 47 and side end flap 51 are foldably connected at a second longitudinal fold line 55 that extends along a length of the blank from the bottom panel 19 to the second side panel 23. The second top end flap 39 is connected to the first top panel 19 at a longitudinal fold line 57. The longitudinal fold lines 53, 55, 57, may be, for example, substantially straight, or offset at one or more locations to account for blank thickness, varying width of the blank panels, or for other factors. In alternative embodiments, the carton 5 could be otherwise shaped, arranged, and/or configured.

The first top panel 13 includes two curved edges 59, 61, the bottom panel 19 includes two curved edges 63, 65 and the second top panel 27 includes two curved edges 67, 69. The first curved edge 59 of the top panel 13 extends from the first longitudinal fold line 53 to an outer edge 71 of the top panel 13. The second curved edge 61 of the top panel 19 extends from the first lateral fold line 17 to the longitudinal fold line 57. The first curved edge 63 of the bottom panel 19 extends from the first longitudinal fold line 53 to the third lateral fold line 25, and the second curved edge 65 of the bottom panel 19 extends from the second lateral fold line 21 to the second longitudinal fold line 55. The first curved edge 67 of the second top panel 27 extends from the fourth lateral fold line 29 to a first edge 73 of the second top panel 27, and the second curved edge 69 of the second top panel 27 extends from a second edge 75 of the second top panel 27 to an outer edge 77 of the second top panel 27.

When the carton 5 is erected, the top end flap 37, bottom end flap 45, side end flaps 41, 49, and corner portion 33 at least partially close a first end 79 of the carton 5, and the top end flap 39, bottom end flap 47, side end flaps 43, 51 and corner portion 31 at least partially close a second end 81 of the carton 5. In accordance with alternative embodiments of the present disclosure, different flap arrangements can be used for at least partially closing the ends 79, 81 of the carton 5.

The corner portions 31, 33 of the first and second side panels 15, 23 respectively form the first and second curved corners 9, 11 of the carton 5. The corner portions 31, 33 each bend around the carton 5 to conform to the curved edges 59, 61, 63, 65, 67, 69 of the top and bottom panels 13, 19, 27 to form the first and second curved corners 9, 11. The plurality of longitudinal fold lines 35 may facilitate shaping the curved corners 9, 11 to conform to the curved edges 59, 61, 63, 65, 67, 69.

The corner portion 33 of the second side panel 23 is defined by two parallel tear lines 83, 85, and the corner portion 33 and parallel tear lines 83, 85 together define a dispenser panel 87. The first parallel tear line 83 extends from the third lateral fold line 25 to the fourth lateral fold line 29 and removably connects the corner portion 33 to the side panel 23, and the second parallel tear line 85 extends across the corner portion 33 and removably connects the corner portion 33 to the end flap 49. It will be appreciated that the dispenser panel 87, corner portions 33, 31, and tear lines 83, 85 could be otherwise shaped, arranged or configured.

The end flaps 41, 51 include first and second tear lines 89, 91, 93, 95 that define first, second, and third portions 97, 99, 101, 103, 105, 107 of the end flaps. The first portion 97 of the first side end flap 41 is foldably connected to the first side panel 15 at the longitudinal fold line 53, the second portion 99 of the first side end flap 41 is connected to the first portion 97 at the tear line 89, and the third portion 101 of the first side end flap 41 is connected to the second portion 99 at the tear line 91. The first portion 103 of the second side end flap 51 is foldably connected to the second side panel 23 at the longitudinal fold line 55, the second portion 105 of the second side end flap 51 is connected to the first portion 103 at the tear line 93, and third portion 107 of the second side end flap 51 is connected to the second portion 105 at the tear line 95. However, the side end flaps 41, 51, tear lines 89, 91, 93, 95, and first second and third portions 97, 99, 101, 103, 105, 107 could be otherwise shaped, arranged, or configured without departing from this disclosure.

The first top panel 13 includes a first access flap 109, and the second top panel 27 includes a second access flap 111. The first and second access flaps 109, 111 each comprise arcuate fold lines 113, 115 that respectively cooperate with the curved edges 59, 67 to form marquise-shaped access flaps 109, 111. When the carton 5 is erected, access flaps 109, 111 substantially overlap proximate a top end 117 of the dispenser panel 87. In use, a user may press on the access flaps 109, 111, causing the flaps 109, 111 to depress, fold, or bend inward (FIG. 4), thus providing access to the top edge 117 of the dispenser panel 87. It will also be appreciated that the access flaps 109, 111 may be otherwise suitably shaped or arranged.

As shown in FIGS. 1-7, a handle 119 may be formed in one or more of the first top panel 13 and second top panel 27. In some embodiments, the handle 119 may be in the form of an arcuate cut 121 suitably sized for insertion of one or more fingers for holding or carrying the carton 5. Other suitable handle arrangements will be apparent to those skilled in the art.

In one exemplary embodiment, the carton 5 can be assembled by partially overlapping the first top panel 13 and the second top panel 27, and positioning the side panels 15, 23 relative to the top panels 13, 27 and the bottom panel 19 to form a generally open-ended tubular sleeve (not shown). When the first and second top panels 13, 27 are overlapped, portions of the first top panel 13 and the second top panel 27 that are overlapped form the handle 119. The partially formed carton 5 can be filled with containers C prior to closing the ends 79, 81 of the carton, or one of the ends 79, 81 can be closed prior to loading the containers C. Once the containers C are loaded, the ends 79, 81 of the carton can be closed by at least partially overlapping at least end flaps 37, 41, 45, 49 to close the first end 79, and at least partially overlapping at least end flaps 39, 43, 47, 51 to close the second end 81. The carton 5 can be assembled and loaded by other positioning steps without departing from the disclosure.

Figure 4:
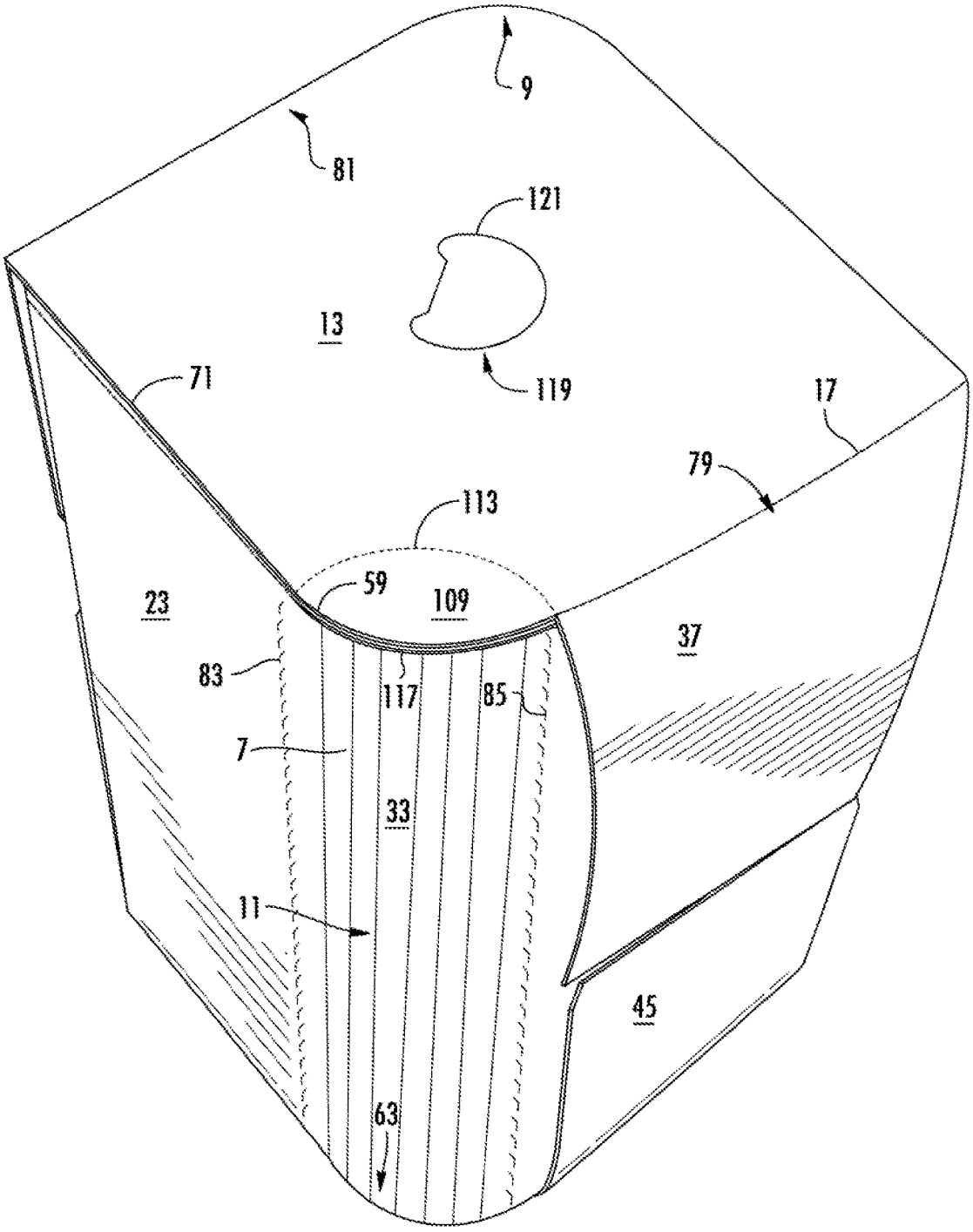
FIG. 4 is a perspective view of a fully formed carton with a depressed access flap according to a first embodiment of this disclosure.

The dispenser 7 according to the embodiment shown in FIGS. 1-8 can be used as follows: A user presses on the access flaps 109, 111 to provide or improve access to the top edge 117 of the corner portion 33 (FIG. 4). The user then grasps and pulls the dispenser panel 87 to respectively separate the dispenser panel 87 from the side section 23 and the end flap 49 at the tear lines 83, 85, providing or improving access to the contents of the carton 5 (FIG. 5). The dispenser 7 can also be opened by other steps without departing from the scope of this disclosure.

According to some embodiments, when the carton 5 is erected, the third portion 101 of the first side end flap 41 mates with the end flap 49 such that the tear line 91 and the tear line 85 are substantially aligned. When the dispenser 7 according to such embodiments is used, the third portion 101 and second portion 99 of the first side end flap 41 will become separated at the tear line 91 as the dispenser panel 87 is separated from the end flap 49 at the tear line 85.

Figure 8:
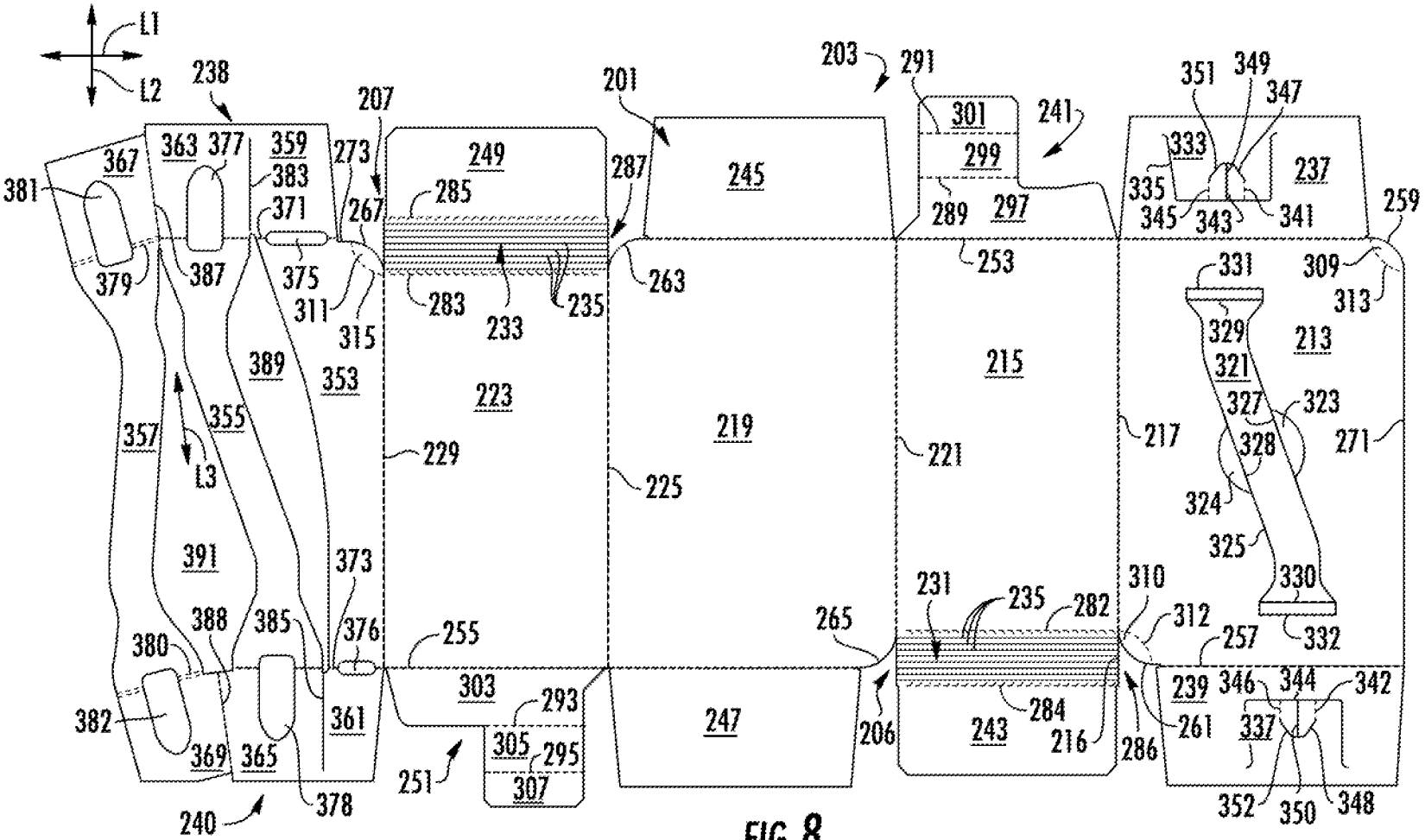
FIG. 8 is a plan view of an exterior surface of a blank for forming a carton according to a second embodiment of this disclosure.
Figure 9:
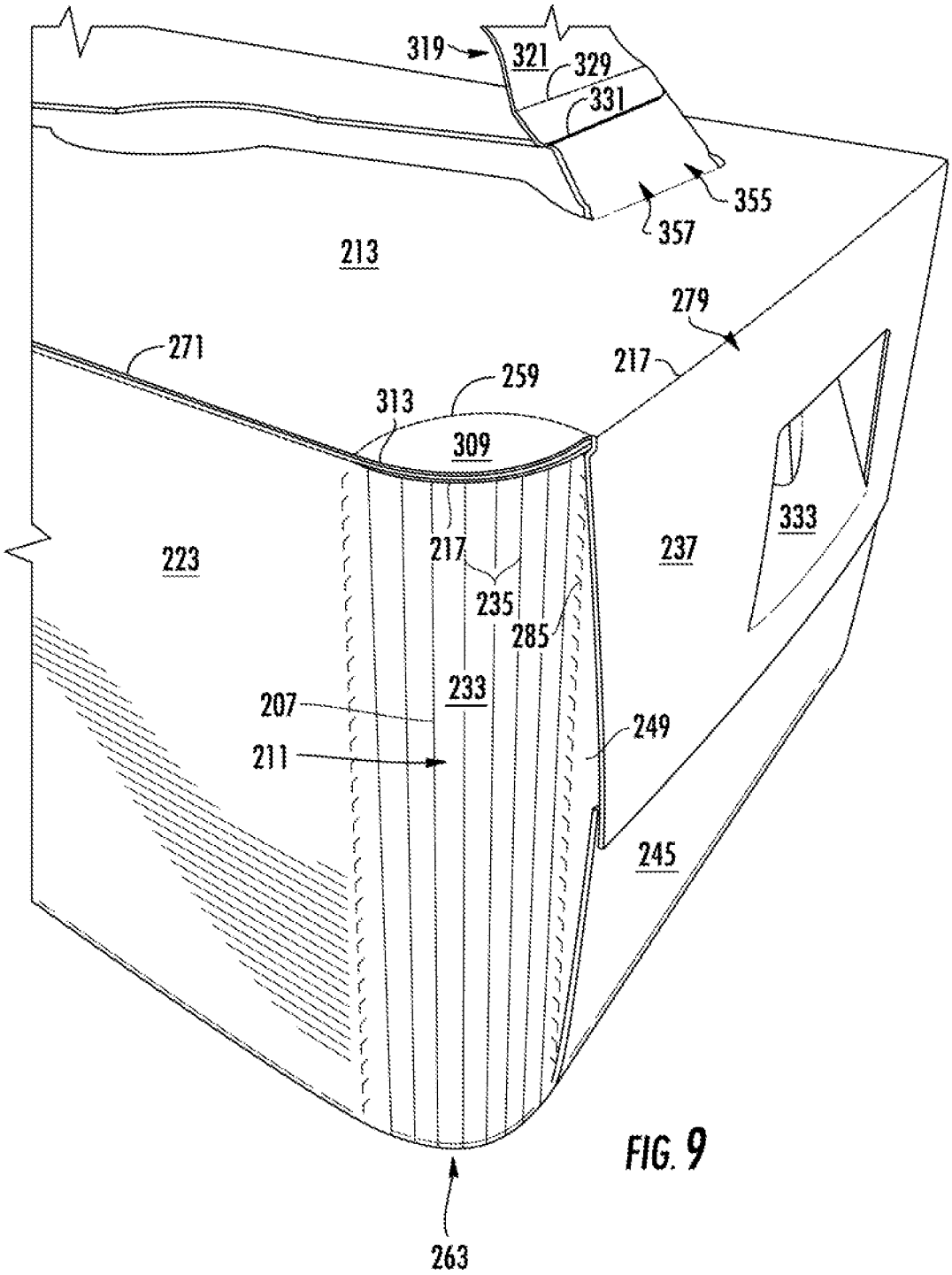
FIG. 9 is a perspective view of a fully formed carton according to a second embodiment of this disclosure.
Figure 11:
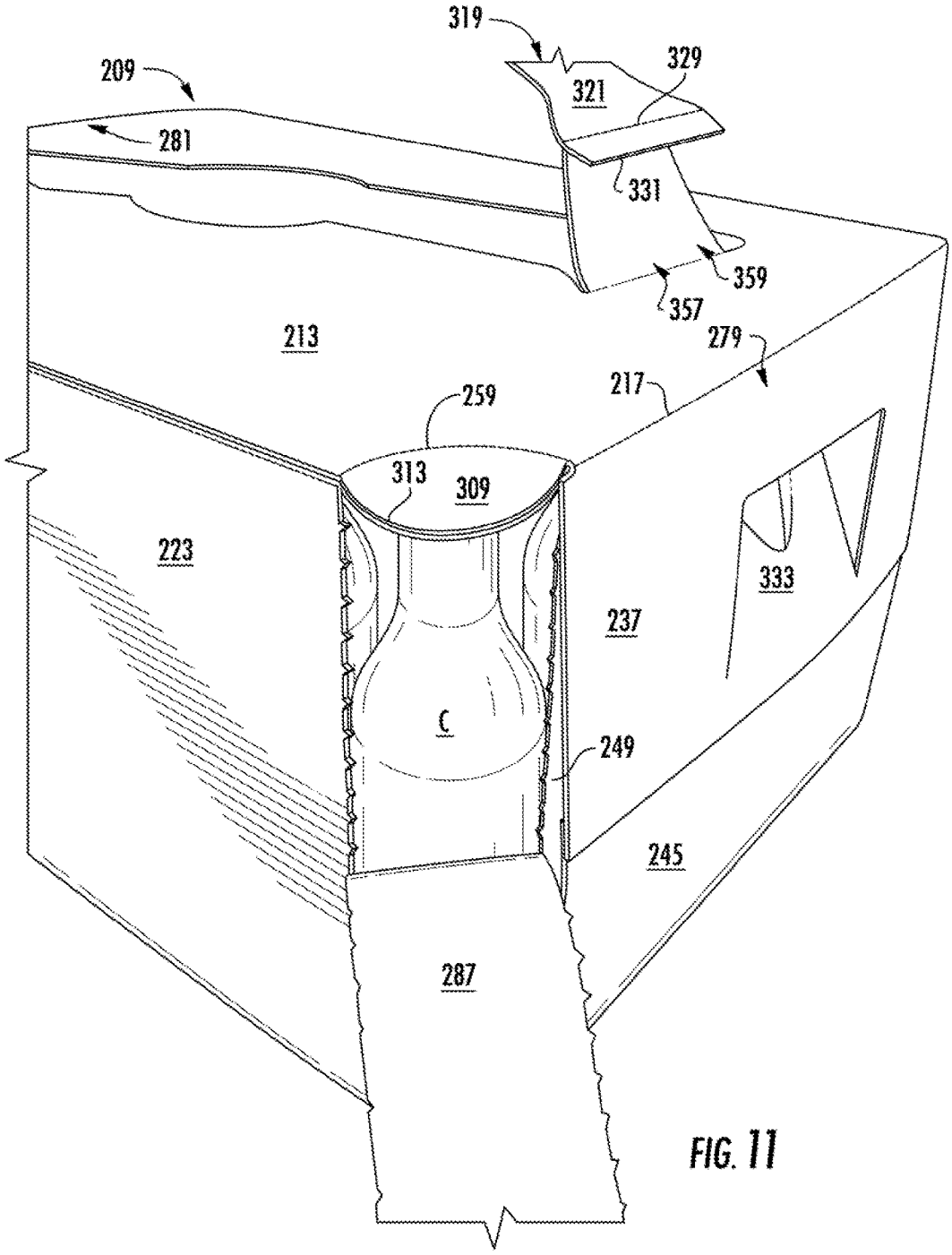
FIG. 11 is a perspective view of a carton with a partially separated opening feature according to a first embodiment of this disclosure.

FIG. 8 is a plan view of the exterior side 201 of a blank, generally indicated at 203, used to form a carton 205 (FIG. 9) according to a second exemplary embodiment of this disclosure. The carton 205 can be used to house a plurality of articles such as containers C (FIG. 11). As shown in FIG. 8, the carton 205 according to one embodiment is sized to house twenty-four containers C in a single layer in a 4×6 arrangement, but it is understood that the carton 205 may be sized and shaped to hold containers of a different or same quantity in more than one layer and/or in different row/column arrangements (e.g., 1×4, 1×6, 2×3, 3×6, 2×6×2, 3×3×2, 4×5, 3×5, 2×9, 2×6, 3×4, etc.). The carton 205 has dispensers 206, 207 for accessing the containers C in the carton 205.

According to some embodiments, the carton 205 has two curved corners 209, 211. As will be discussed in further detail below, the dispenser 207 is located at one or more of the curved corners 209, 211 of the carton. The carton 205 can be closed (FIG. 9) for containing containers C and opened (FIG. 10) to allow easy access to the containers C in the carton 205.

In the embodiment of FIG. 8, the carton blank 203 has a longitudinal axis L1 and a lateral axis L2. The blank 203 comprises a first top panel 213 foldably connected to a first side panel 215 at a first lateral fold line 217. A bottom panel 219 is foldably connected to the first side panel 215 at a second lateral fold line 221. A second side panel 223 is foldably connected to the bottom panel 219 at a third lateral fold line 225. A second top panel 227 is foldably connected to the second side panel 223 at a fourth lateral fold line 229. The first and second side panels 215, 223 each include a respective corner portion 231, 233 having a plurality of longitudinal fold lines 235. In alternative embodiments, the blank 203 can have alternative panel arrangements.

The first top panel 213 is foldably connected to a first top end flap 237 and a second top end flap 239. The first side panel 215 is foldably connected to a first side end flap 241 and a second side end flap 243. The bottom panel 219 is foldably connected to a first bottom end flap 245 and a second bottom end flap 247. The second side panel 223 is foldably connected to a first side end flap 249 and a second side end flap 251. The second top panel 227 is foldably connected to a first top end flap 238 and a second top end flap 240.

The first top end flaps 237, 238, first side end flaps 241, 249, and first bottom end flap 245 extend along a first marginal area of the blank 203, and the top end flap 213, bottom end flap 245, and side end flap 241 are foldably connected at a first longitudinal fold line 253 that extends along a length of the blank from the first top panel 213 to the bottom panel 219. The second top end flaps 239, 240, second side end flaps 243, 251, and second bottom end flap 247 extend along a second marginal area of the blank 203. The bottom end flap 247, side end flap 251, and second top end flap 240 are foldably connected at a second longitudinal fold line 255 that extends along a length of the blank from the bottom panel 219 to the second top panel 227, and the second top end flap 239 is connected to the first top panel 213 at a longitudinal fold line 257. The longitudinal fold lines 253, 255, 257, may be, for example, substantially straight, or offset at one or more locations to account for blank thickness, varying width of the blank panels, or for other factors. In alternative embodiments, the carton 205 could be otherwise shaped, arranged, or configured.

The first top panel 213 includes two curved edges 259, 261, the bottom panel 219 includes two curved edges 263, 265 and the second top panel 227 includes curved edge 267. The first curved edge 259 of the top panel 213 extends from the first longitudinal fold line 253 to an outer edge 271 of the top panel 213. The second curved edge 261 of the first top panel 219 extends from the first lateral fold line 217 to the longitudinal fold line 257. The first curved edge 263 of the bottom panel 219 extends from the first longitudinal fold line 253 to the third lateral fold line 225, and the second curved edge 265 of the bottom panel 219 extends from the second lateral fold line 221 to the second longitudinal fold line 255. The curved edge 267 of the second top panel 227 extends from the fourth lateral fold line 229 to a first edge 273 of the second top panel 227.

When the carton 205 is erected, the top end flaps 237, 238, bottom end flap 245, side end flaps 241, 249, and corner portion 233 at least partially close a first end 279 of the carton 205, and the top end flaps 239, 240, bottom end flap 247, side end flaps 243, 251 and corner portion 231 at least partially close a second end 281 of the carton 205. In accordance with alternative embodiments of the present disclosure, different flap arrangements can be used for at least partially closing the ends 279, 281 of the carton 205.

The corner portions 231, 233 of the first and second side panels 215, 223 respectively form the first and second curved corners 209, 211 of the carton 205. The corner portions 231, 233 each bend around the carton 205 to conform to the curved edges 259, 261, 263, 265, 267 of the top and bottom panels 213, 219, 227 to form the first and second curved corners 209, 211. The plurality of longitudinal fold lines 235 may facilitate shaping the curved corners 209, 211 to conform to the curved edges 259, 261, 263, 265, 267.

The corner portion 231 of the first side panel 215 is defined by two parallel tear lines, 282, 284, and the corner portion 231 and parallel tear lines 282, 284 together define a first dispenser panel 286. The corner portion 233 of the second side panel 223 is defined by two parallel tear lines 283, 285, and the corner portion 233 and parallel tear lines 283, 285 together define a second dispenser panel 287.

The first parallel tear line 282 for the first dispenser panel 286 extends from the first lateral fold line 217 to the second lateral fold line 221 and removably connects the corner portion 231 to the first side panel 215, and the second parallel tear line 284 extends across the corner portion 231 and removable connects the corner portion 231 to the end flap 243. The first parallel tear line 283 for the second dispenser panel 287 extends from the third lateral fold line 225 to the fourth lateral fold line 229 and removably connects the corner portion 233 to the side panel 223, and the second parallel tear line 285 extends across the corner portion 233 and removably connects the corner portion 233 to the end flap 249. It will be appreciated that the dispenser panels 286, 287, corner portions 231, 233, and tear lines 282, 283, 284, 285 could be otherwise shaped, arranged or configured.

The end flaps 241, 251 include first and second tear lines 289, 291, 293, 295 that define first, second, and third portions 297, 299, 301, 303, 305, 307 of the end flaps. The first portion 297 of the first side end flap 241 is foldably connected to the first side panel 215 at the longitudinal fold line 253, the second portion 299 of the first side end flap 241 is connected to the first portion 297 at the tear line 289, and the third portion 301 of the first side end flap 241 is connected to the second portion 299 at the tear line 291. The first portion 303 of the second side end flap 251 is foldably connected to the second side panel 223 at the longitudinal fold line 255, the second portion 305 of the second side end flap 251 is connected to the first portion 303 at the tear line 293, and third portion 307 of the second side end flap 251 is connected to the second portion 305 at the tear line 295. However, the side end flaps 241, 251, tear lines 289, 291, 293, 295, and first second and third portions 297, 299, 301, 303, 305, 307 could be otherwise shaped, arranged, or configured without departing from this disclosure.

The first top panel 213 includes a first access flap 309, and the second top panel 227 includes a second access flap 311. The first and second access flaps 309, 311 each comprise arcuate fold lines 313, 315 that respectively cooperate with the curved edges 259, 267 to form marquise-shaped access flaps 309, 311. When the carton 205 is erected, the access flaps 309, 311 substantially overlap proximate a top end 317 of the dispenser panel 287. In use, a user may press on the access flaps 309, 311, causing the flaps 309, 311 to depress, fold, or bend inward (FIG. 10), thus providing access to the top edge 317 of the dispenser panel 287. It will be appreciated that the access flaps 309, 311 may be otherwise suitably shaped, arranged, or omitted.

The first top panel 213 also includes an access flap 310 comprising an arcuate fold line 312 that cooperates with the curved edge 261 to a form marquise-shaped access flap 310. When the carton 205 is erected, the access flap 310 is located proximate a top end 316 of the dispenser panel 286. In use, a user may press on the access flap 310, causing the flap 310 to fold or bend inward, thus providing access to the top edge 316 of the dispenser panel 286. It will be appreciated that the access flap 310 may be otherwise suitably shaped, arranged, or omitted.

As shown in FIG. 8, the carton blank 203 further includes a reinforced handle 319 that is formed from features of the top panels 213, 227. The first top panel 213 includes a handle strip 321 having handle strip tabs 323, 324. The handle strip 321 and tabs 323, 324 are removably attached to the top panel 213 at a tear line 325. The handle strip tab 323 is foldably connected to the handle strip 315 at a fold line 327, and the handle strip tab 324 is foldably connected to the handle strip 315 at a fold line 328. The handle strip 315 according to some embodiments also includes a crease line 329 proximate a first end 331 of the handle strip 321, and a crease line 330 proximate a second end 332 of the handle strip 321. The carton blank 203 also includes features for reinforcing the handle 321, as follows.

The end flap 237 includes a tab 333 defined by a tear line 335, and the end flap 239 includes a tab 337 defined by a tear line 339. According to some embodiments, the tear lines 335, 339 each respectively comprise three sides of a rectangular or trapezoidal shape, such that tabs 333, 337 are substantially rectangular or trapezoidal when partially separated from the end flaps 237, 239 at the tear lines 335, 339. The tabs 333, 337 each respectively include a first tear line 341, 342, a second, middle tear line, 343, 344, and a third tear line 345, 346.

Each of the tear lines 341, 343, 345 extends orthogonally from the tear line 335 at a first end of the tear line 342, 344, 346. Fold lines 347, 349, 351 each respectively extend from a second end of the tear lines 341, 343, 345 at a first end of the fold line 347, 349, 351. The fold line 349 is collinear with the tear line 343. The fold lines 347, 351 respectively extend from the first tear line 341 and the third tear line 345 at an angle relative to the tear lines 341, 345 such that a second end of each of the fold lines 347, 349, 351 converges at approximately the same point.

Each of the tear lines 342, 344, 346 extends orthogonally from the tear line 339 at a first end of the tear line 342, 344, 346. Fold lines 348, 350, 352 each respectively extend from a second end of the tear lines 342, 344, 346 at a first end of the fold line 348, 350, 352. The fold line 350 is collinear with the tear line 344. The fold lines 348, 352 respectively extend from the first tear line 342 and the third tear line 346 at an angle relative to the tear lines 342, 346 such that a second end of each of the fold lines 348, 350, 352 converges at approximately the same point.

The second top panel 227 includes a first top panel portion 353 foldably connected to the second side panel 223, a second top panel portion 355, and a third top panel portion 357 foldably connected to the second top panel portion 355. The second top panel portion 355 and third top panel portion 357 are symmetrical about an axis L3. However, it will also be apparent that the first, second, and third top panel portions 353, 355, 357 may be otherwise suitably arranged or shaped.

The first top panel portion 353 is foldably connected to a first end flap portion 359 and a first end flap portion 361. The second top panel portion 355 is foldably connected to a second end flap portion 363 and a second end flap portion 365. The third top panel portion 357 is foldably connected to a third end flap portion 367 and a third end flap portion 369. The first, second, and third end flap portions 359, 363, 367, together form the top end flap 238, and he first, second, and third end flap portions 361, 365, 369, together form the top end flap 240.

The first top panel portion 353 is foldably connected to the first end flap portion 359 at a longitudinal fold line 371. Similarly, the first top panel portion 353 is foldably connected to the first end flap portion 361 at a longitudinal fold line 373. According to some embodiments, the longitudinal fold line 371 and the longitudinal fold lines 373 are respectively collinear with the longitudinal fold line 253 and the longitudinal fold line 255.

An oval shaped cut-out 375 is included along the fold line 371 between the first top panel portion 353 and the end flap portion 359. Another oval shaped cut-out 376 is included along the fold line 373 between the first top panel portion 353 and the end flap portion 361. The cut-outs 375, 376 may facilitate bending, folding, or shaping of the carton. As shown in FIG. 8, the cut-out 375 may be longer than the cut-out 376 to accommodate the shape of the first top panel portion 353.

The second top panel portion 355 is foldably connected to the second end flap portion 363 at the longitudinal fold line 371. A bullet shaped cut-out 377 is included along the fold line 373 between the second top panel portion 355 and the second end flap portion 363. Similarly, the second top panel portion 355 is foldably connected to the second end flap portion 365 at the longitudinal fold line 373. Another bullet shaped cut-out 378 is included along the fold line 373 between the second top panel portion 355 and the second end flap portion 365.

The third top panel portion 357 is foldably connected to the third end flap portion 367 at a fold line 379. A bullet shaped cut-out 381 is included along the fold line 379 between the third top panel portion 357 and the third end flap portion 367. Similarly, the third top panel portion 357 is foldably connected to the third end flap portion 369 at a fold line 380. Another bullet shaped cut-out 382 is included along the fold line 380 between the third top panel portion 357 and the third end flap portion 369. The cut-outs 377, 378, 381, 382 may facilitate bending, folding, or shaping of the carton.

The first end flap portion 359 is foldably connected to the second end flap portion 363 at a lateral tear line 383, and the first end flap portion 361 is foldably connected to the second end flap portion 365 at a lateral tear line 385. The second end flap portion 363 is connected to the third end flap portion 367 at a fold line 387, and the second end flap portion 365 is connected to the third end flap portion 369 at a fold line 388. According to some embodiments, the fold lines 387, 388 are collinear with the axis L3. However, it will be apparent that the end flap portions 359, 361, 363, 365, 367, 369 may be otherwise connected or arranged.

A cutout 389 is located between the first portion 353 and the second portion 355 and between the tear line 383 and the tear line 385. The cutout 389 is shaped such that the shape of the second portion 355 cooperates with the shape of the handle strip 321 when the carton 205 is erected. Another cutout 391 is located between the second portion 355 and the third portion 357 and along the fold lines 387, 388. The cutout 391 is shaped such that the second portion 355 and the third portion 357 are symmetrical about the axis L3, and such that the second and third portions 355, 357 cooperate with the shape of the handle strip 321 when the carton 205 is erected to form a reinforced handle 319.

In one exemplary embodiment, the carton 205 can be assembled by partially overlapping the first top panel 213 and the second top panel 227, and positioning the side panels 215, 223 relative to the top panels 213, 227 and the bottom panel 219 to form a generally open-ended tubular sleeve (not shown).

The partially formed carton 205 can be filled with containers C prior to closing the ends 279, 281 of the carton, or one of the ends 279, 281 can be closed prior to loading the containers C. Once the containers C are loaded, the ends 279, 281 of the carton can be closed by at least partially overlapping at least end flaps 237, 238, 241, 245, 249 to close the first end 279, and at least partially overlapping at least end flaps 239, 240, 243, 247, 251, to close the second end 281. The carton 205 can be assembled and loaded by other positioning steps without departing from the disclosure.

When the first and second top panels 213, 227 are overlapped, portions of the first top panel 213 and the second top panel 227 that are overlapped form the handle 319. To form the handle 319, the third top panel portion 357 can be folded along the fold lines 387, 388 to a face-to-face position with the second portion 359 prior to forming the carton 205. When the carton 205 is erected, the first top panel 213 will overlap the second top panel 227 such that the handle strip 321 overlays the face-to-face second and third portions 355, 357 of the second top panel 227 to form the handle 319.

To use the handle 319, a user may press on the tabs 323, 324 to separate them from the first top panel 213 at the tear line 325 and to create an opening that aids the user in gripping and separating the handle strip 321 from the first top panel 213. The second and third portions 355, 357 of the second top panel 227 can then be pulled through the opening created by the separation of the handle strip 321 from the first top panel 213. According to some embodiments, the tabs 323, 324 may be folded along the fold lines 321 and around the second and third portions 355, 357 of the second top panel 227 to reinforce the handle 319. Also according to some embodiments, the handle strip 321 may be otherwise or additionally attached to the second portion 355, the third portion 357, or both at or near one or more of the crease lines 329, 330 by means of a staple, an adhesive, or the like. However, it will be appreciated that the handle strip 321 could be otherwise attached or configured, or not attached to the second and third portions 355, 357.

When the carton 205 is erected, the top panel end flap 237 will overlap the bottom panel end flap portions 359, 363, 367, and the top panel end flap 239 will overlap the bottom panel end flap portions 361, 365, 369. The handle tabs 333, 337 are respectively partially separated from the end flaps 237, 239 at the tear lines 335, 339. In this configuration, the tear lines 341, 342, 343, 344, 345, 346 and fold lines 347, 348, 349, 350, 351, 352 will substantially overlap the bullet shaped cut-outs 377, 378, 381, 382. According to some embodiments, the second end flap portions 363, 365 may be attached or adhered to the tab 333, the third end flap portion 367, 369 may be attached or adhered to the tab 335. When the end flap portions 363, 365, 367, 369 are so adhered, the handle tabs 333, 335 will cooperate with at least the end flap portions 363, 365, 367, 369 to cause the tabs 333, 335 to pull inward as the handle 319 is used and may in this way aid in reinforcing the handle 319.

Figure 10:
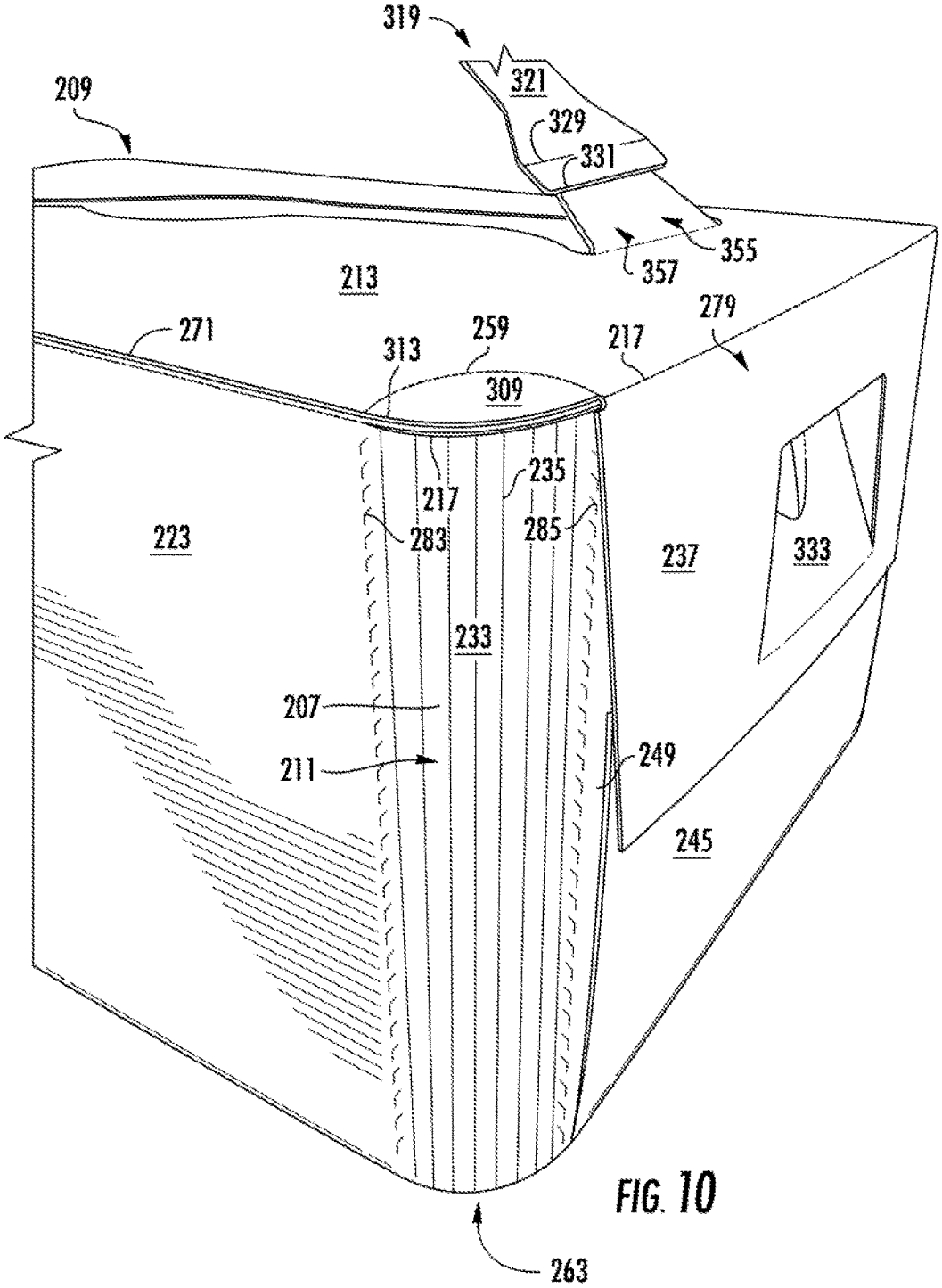
FIG. 10 is a perspective view of a fully formed carton with a depressed access flap according to a second embodiment of this disclosure.
Figure 12:
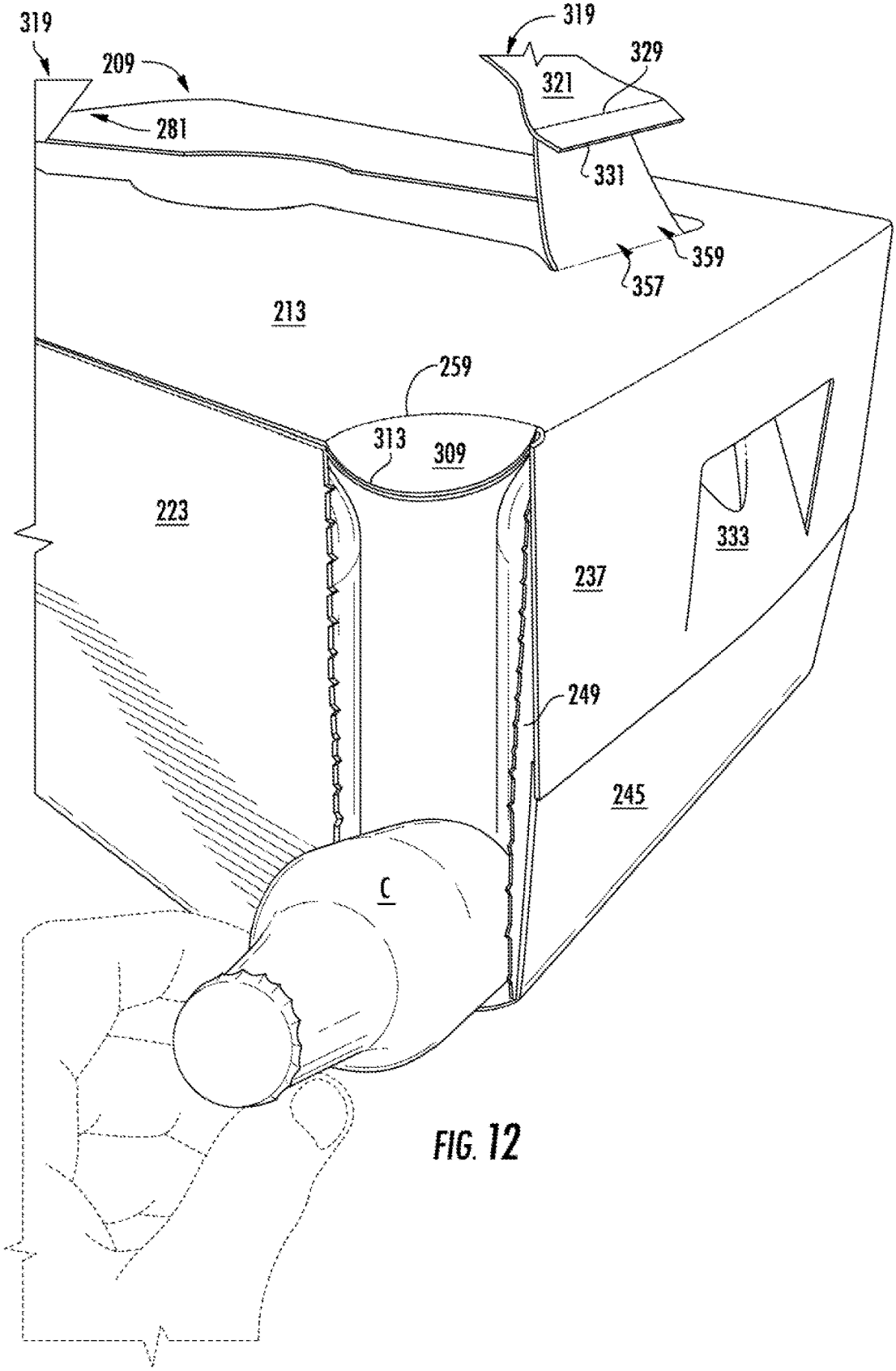
FIG. 12 is a perspective view of a fully formed carton with a separated opening feature and a container being removed according to a first embodiment of this disclosure.

The dispenser 207 according to the embodiment shown in FIGS. 9-12 can be used as follows: A user presses on the access flaps 309, 311 to provide or improve access to the top edge 317 of the corner portion 233 (FIGS. 10-11). The user then grasps and pulls the dispenser panel 287 to respectively separate the dispenser panel 287 from the side section 223 and the end flap 249 at the tear lines 283, 285, providing or improving access to the contents of the carton 205 (FIGS. 11-12). The dispenser 207 can also be opened by other steps without departing from the scope of this disclosure.

According to some embodiments, when the carton 205 is erected, the third portion 301 of the first side end flap 241 mates with the end flap 249 such that the tear line 291 and the tear line 285 are substantially aligned. When the dispenser 207 according to such embodiments is used, the third portion 301 and second portion 299 of the first side end flap 241 will become separated at the tear line 291 as the dispenser panel 287 is separated from the end flap 249 at the tear line 285.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton holding a plurality of containers in a single layer, the carton comprising:

a plurality of panels that extends at least partially around an interior of the carton, the plurality of panels comprising a top panel, a bottom panel, a first side panel, and a second side panel, the plurality of panels arranged such that a top of each container of the plurality of containers is adjacent the top panel and a bottom of each container of the plurality of containers is adjacent the bottom panel;

at least two end flaps respectively foldably connected to a respective panel of the plurality of panels, the at least two end flaps are overlapped with respect to one another to at least partially form a closed end of the carton;

a curved corner extending from at least one panel of the plurality of panels to the closed end of the carton; and a dispenser for allowing removal of at least one container of the plurality of containers from the carton, the dispenser comprising a dispenser panel that is at least partially defined by a tear line in the carton and is for being at least partially removed for at least further opening a dispenser opening, the dispenser panel comprises at least a portion of the curved corner.

2. The carton of claim 1, wherein the curved corner of the carton comprises a corner portion of at least one of the plurality of panels.

3. The carton of claim 2, wherein the at least one of the plurality of panels comprises at least one of the first side panel and the second side panel.

4. The carton of claim 3, wherein the curved corner comprises a curved edge of at least one of the top panel and the bottom panel, the corner portion conforms to the curved edge at the curved corner.

5. The carton of claim 4, wherein the curved edge is a first curved edge in the top panel and the curved corner comprises a second curved edge in the bottom panel, the corner portion conforms to the first curved edge and the second curved edge.

6. The carton of claim 5, wherein the top panel comprises an access flap, the access flap comprises the first curved edge.

7. The carton of claim 6, wherein the access flap is foldably connected to the top panel for accessing the dispenser panel.

8. The carton of claim 4, wherein the corner portion comprises a plurality of longitudinal fold lines.

9. The carton of claim 3, wherein the tear line comprises a first tear line and a second tear line, the first tear line removably connecting the dispenser panel to the at least one of the first side panel and the second side panel.

10. The carton of claim 9, wherein the plurality of end flaps comprises a side end flap foldably connected to the at least one of the first side panel and the second side panel, the second tear line removably connecting the dispenser panel to the side end flap.

11. The carton of claim 1, wherein the at least two end flaps are at least two first end flaps and the closed end is a first end, the carton comprises at least two second end flaps respectively foldably connected to a respective panel of the plurality of panels, the at least two second end flaps are overlapped with respect to one another to at least partially close a second end of the carton, the curved corner is a first curved corner, the carton comprises a second curved corner extending from at least one panel of the plurality of panels to the second end.

12. The carton of claim 11, wherein the dispenser panel is a first dispenser panel and the tear line is a first tear line, the dispenser comprises a second dispenser panel at least partially defined by a second tear line in the carton and that comprises at least a portion of the second curved corner.

13. The carton of claim 1, further comprising a handle formed in the top panel.

14. The carton of claim 13, wherein the top panel is a first top panel, the carton further comprises a second top panel, the first top panel overlays the second top panel, and the handle is formed in the first top panel and the second top panel.

15. The carton of claim 14, wherein the first top panel comprises a handle strip, the second top panel includes a first top panel portion, a second top panel portion, and a third top panel portion, and the first top panel portion and second top panel portion are configured to cooperate with the handle strip to form the handle.

16. The carton of claim 1, wherein the tear line extends from the top panel to the bottom panel.

17. The carton of claim 1, further comprising at least one orthogonal corner.

18. The carton of claim 17, wherein the closed end is a first closed end of the carton, the carton comprises a second closed end opposite the first closed end, and the at least one orthogonal corner is between the at least one panel and the second closed end.

19. A blank for forming a carton for holding a plurality of containers in a single layer, the blank comprising:

a plurality of panels comprising a top panel, a bottom panel, a first side panel, and a second side panel, the plurality of panels for extending at least partially around an interior of the carton formed from the blank such that a top of each container of the plurality of containers is adjacent the top panel and a bottom of each container of the plurality of containers is adjacent the bottom panel;

at least two end flaps respectively foldably connected to a respective panel of the plurality of panels, the at least two end flaps are for being overlapped with respect to one another to at least partially form a closed end of the carton formed from the blank;

at least one panel of the plurality of panels comprises a corner portion for forming a curved corner extending from the at least one panel of the plurality of panels to the closed end of the carton formed from the blank; and dispenser features for forming a dispenser for allowing removal of at least one container of the plurality of containers from the carton formed from the blank, the dispenser features comprising a dispenser panel that is at least partially defined by a tear line in the blank and is for being at least partially removed for at least further opening a dispenser opening, the dispenser panel comprises at least a portion of the corner portion.

20. The blank of claim 19, wherein the at least one of the plurality of panels comprises at least one of the first side panel and the second side panel.

21. The blank of claim 20, wherein at least one of the top panel and the bottom panel comprises a curved edge for forming the curved corner of the carton formed from the blank, the corner portion conforms to the curved edge at the curved corner of the carton formed from the blank.

22. The blank of claim 21, wherein the curved edge is a first curved edge in the top panel and the blank comprises a second curved edge in the bottom panel, the corner portion conforms to the first curved edge and the second curved edge in the carton formed from the blank.

23. The blank of claim 22, wherein the top panel comprises an access flap, the access flap comprises the first curved edge.

24. The blank of claim 21, wherein the curved edge extends from the at least one of the first side panel and the second side panel to an end flap of the at least two end flaps.

25. The blank of claim 24, wherein the at least one of the top panel and the bottom panel comprises the top panel and the end flap is a top end flap foldably connected to the top panel.

26. The blank of claim 20, wherein the tear line comprises a first tear line and a second tear line, the first tear line removably connecting the dispenser panel to the at least one of the first side panel and the second side panel.

27. The blank of claim 26, wherein the at least two end flaps comprises a side end flap foldably connected to the at least one of the first side panel and the second side panel, the second tear line removably connecting the dispenser panel to the side end flap.

28. The blank of claim 19, wherein the corner portion comprises a plurality of longitudinal fold lines.

29. The blank of claim 19, wherein the at least two end flaps are at least two first end flaps and the closed end is a first end, the carton comprises at least two second end flaps respectively foldably connected to a respective panel of the plurality of panels, the at least two second end flaps are overlapped with respect to one another to at least partially close a second end of the carton, the corner portion is a first corner portion in the first side panel and the curved corner is a first curved corner, the carton comprises a second corner portion in the second side panel for forming a second curved corner extending from the second side panel to the second end of the carton formed from the blank.

30. The carton of claim 29, wherein the dispenser panel is a first dispenser panel and the tear line is a first tear line, the dispenser features comprise a second dispenser panel at least partially defined by a second tear line in the blank and that comprises at least a portion of the second corner portion.

31. The blank of claim 19, wherein the tear line extends from the top panel to the bottom panel.

32. A method of forming a carton holding a plurality of containers, the method comprising:

obtaining a blank comprising a plurality of panels comprising a top panel, a bottom panel, a first side panel, and a second side panel, at least two end flaps respectively foldably connected to a respective panel of the plurality of panels, at least one panel of the plurality of panels comprises a corner portion, dispenser features for forming a dispenser, the dispenser features comprising a dispenser panel that is at least partially defined by a tear line in the blank and is for being at least partially removed for at least further opening a dispenser opening, the dispenser panel comprises at least a portion of the corner portion;

obtaining a plurality of containers;

forming an interior of the carton at least partially defined by the plurality of panels;

placing the plurality of containers in the interior of the carton in a single layer such that a top of each container of the plurality of containers is adjacent the top panel and a bottom of each container of the plurality of containers is adjacent the bottom panel;

at least partially forming a closed end of the carton by at least partially overlapping the at least two end flaps; and forming a curved corner extending from the at least one panel of the plurality of panels to the closed end by folding the corner portion to form the curved corner, the dispenser panel comprises at least a portion of the curved corner.

33. The method of claim 32, wherein the at least one of the plurality of panels comprises at least one of the first side panel and the second side panel, the blank comprises a curved edge of at least one of the top panel and the bottom panel, the forming the curved corner comprises conforming the corner portion to the curved edge.

34. The method of claim 33, wherein the curved edge is a first curved edge in the top panel and the curved corner comprises a second curved edge in the bottom panel, the forming the curved corner comprises conforming the corner portion to the first curved edge and the second curved edge.

35. The method of claim 34, wherein the tear line comprises a first tear line and a second tear line and the plurality of end flaps comprises a side end flap foldably connected to the at least one of the first side panel and the second side panel, the method comprises removing the dispenser panel from the at least one of the first side panel and the side end flap by tearing along the first tear line and the second tear line.

36. The method of claim 35, wherein the top panel comprises an access flap, the method comprising folding the access flap to access the dispenser panel to initiate the tearing along the first tear line and the second tear line.

37. The method of claim 36, wherein the access flap comprises the first curved edge.

38. The method of claim 32, wherein the at least two end flaps are at least two first end flaps and the closed end is a first end, the carton comprises at least two second end flaps respectively foldably connected to a respective panel of the plurality of panels, the method comprising at least partially closing a second end by at least partially overlapping the at least two second end flaps, the corner portion is a first corner portion foldably connected to the first side panel and the curved corner is a first curved corner, the blank comprises a second corner portion foldably connected to the second side panel, and the method comprises forming a second curved corner extending from the second side panel to the second end by folding the second corner portion to form the second curved corner.

39. The method of claim 38, wherein the dispenser panel is a first dispenser panel and the tear line is a first tear line, the dispenser comprises a second dispenser panel at least partially defined by a second tear line in the carton and that comprises at least a portion of the second curved corner.

40. The method of claim 32, wherein the tear line extends from the top panel to the bottom panel.

41. The method of claim 32, further comprising forming at least one orthogonal corner of the carton.

42. The method of claim 41, wherein the closed end is a first closed end of the carton, the method further comprising at least partially forming a second closed end of the carton, the second closed end opposite the first closed end, and the at least one orthogonal corner is between the at least one panel and the second closed end of the carton.

* * * * *